US006348863B1

(12) United States Patent
Krubiner et al.

(10) Patent No.: US 6,348,863 B1
(45) Date of Patent: Feb. 19, 2002

(54) METHOD AND APPARATUS FOR DETECTING MOVING OBJECTS, PARTICULARLY INTRUSIONS

(75) Inventors: Dan Krubiner, Tel-Aviv; Bar Strauss, Matan; Eyal Yagoda, Tel-Aviv, all of (IL)

(73) Assignee: Electronics Line (E.L.) Ltd, Petach Tikva (IL)

( * ) Notice: Subject to any disclaimer, the term of this patent is extended or adjusted under 35 U.S.C. 154(b) by 67 days.

(21) Appl. No.: 09/589,373

(22) Filed: Jun. 8, 2000

(30) Foreign Application Priority Data

Jun. 9, 1999 (IL) ..... 130398

(51) Int. Cl.[7] ..... G08B 13/18

(52) U.S. Cl. ..... 340/567; 340/545.1; 340/545.8; 340/523; 250/342; 250/349

(58) Field of Search ..... 340/567, 545.1, 340/541, 545.2, 545.8, 572.2, 573.1, 506, 523, 554; 250/342, 349

(56) References Cited

U.S. PATENT DOCUMENTS 4,710,629 A * 12/1987 Muller et al. ..... 250/342
4,963,749 A * 10/1990 McMaster ..... 250/349
5,291,020 A * 3/1994 Lee ..... 250/342
5,382,944 A * 1/1995 Dipoala et al. ..... 340/567
5,493,118 A * 2/1996 Okuda et al. ..... 250/338.3
5,870,022 A * 2/1999 Kuhnly et al. ..... 340/567

* cited by examiner

*Primary Examiner*—Jeffery Hofsass
*Assistant Examiner*—Tai T. Nguyen
(74) *Attorney, Agent, or Firm*—Eitan, Pearl, Latzer & Cohen-Zedek

(57) ABSTRACT

A method and apparatus for detecting for detecting intrusions, such as intrusions through a door or window of a room, in a manner which ignores movements in other adjacent regions, is provided. The method of detecting intrusions with respect to a monitored space includes exposing the monitored space to a passive infrared sensor having a first sensor element generating a positive polarity signal when its field of view senses an infrared-radiating moving object, and a second sensor element generating a negative polarity signal when its field of view senses an infrared-radiating moving object; generating a movement signal consisting of a positive polarity signal and a negative polarity signal when both have been generated within a first time interval such as to indicate the movement of an object within the monitored space; determining from the relative sequential order of the positive polarity signal and negative polarity signal in the movement signal the direction of movement of the detected object, and particularly whether the movement direction is a hostile direction or a friendly direction; and actuating an alarm when the direction of movement of the movement signal is determined to be in the hostile direction, but not when it is determined to be in the friendly direction.

20 Claims, 8 Drawing Sheets

METHOD AND APPARATUS FOR DETECTING MOVING OBJECTS, PARTICULARLY INTRUSIONS

FIELD AND BACKGROUND OF THE INVENTION

The present invention relates to a method and apparatus for detecting objects by the use of passive infrared sensors. The invention is especially useful for detecting intrusions through a door or window, and is therefore described below with respect to such an application, but as will be pointed out below, the invention could be advantageously used in many other applications as well Passive infrared (hereinafter "PIR") sensors are widely used for detecting infrared (IR) radiating bodies, such as a person, particularly for detecting intrusions in monitored spaces. Where the ambient temperature is less than body temperature (e.g., above 36° C.), the radiation generated by the intruder can be sensed to trigger an alarm.

There are many applications, however, where it is desired to monitor a limited space, such as the region adjacent to a window or door of a room, in order to detect an intrusion through the window or door, but to ignore movements in other regions within the room. In such applications, it is necessary to install the PIR detector system very precisely in order to make it sensitive only to movements within the region to be protected and to make it insensitive to movements outside that region. In addition, it is also frequently necessary to use a PIR detector internally of the room and another one externally of the room in order to enable the system to detect movement in the "hostile" direction, (i.e., through the window or door into the room) and to make it insensitive to movements in the friendly direction, (i.e., within the room or towards window or door).

PIR detectors are also used in other applications, such as for controlling automatic doors.

OBJECT AND BRIEF SUMMARY OF THE INVENTION

One object of the present invention is to provide a method, and also an apparatus, for detecting objects in a manner which enables the direction of movement of the object to be easily determined. Another object of the invention is to provide a method, and also an apparatus, for detecting intrusions, such as intrusions through a door or window of a room, in a manner which ignores movements in other adjacent regions.

According to one aspect of the present invention, there is provided a method of detecting intrusions with respect to a monitored space comprising: exposing the monitored space to a passive infrared sensor having a first sensor element generating a positive polarity signal when its field of view senses an infrared-radiating moving object, and a second sensor element generating a negative polarity signal when its field of view senses an infrared-radiating moving object; generating a movement signal consisting of a positive polarity signal and a negative polarity signal when both have been generated within a first time interval such as to indicate the movement of an object within the monitored space; determining from the relative sequential order of the positive polarity signal and negative polarity signal in the movement signal the direction of movement of the detected object, and particularly whether the movement direction is a hostile direction or a friendly direction; and actuating an alarm when the direction of movement of the movement signal is determined to be in the hostile direction, but not when it is determined to be in the friendly direction.

According to further features in the described preferred embodiment, the method further comprises disabling the actuation of the alarm during a second time interval after a generated movement signal has been determined to be in the friendly direction. More particularly, the disabling of the actuation of the alarm is effected by applying each movement signal, after a short time delay, to restart the second time interval during which the actuation of the alarm is disabled.

As will be described more particularly below, such a method actuates the alarm upon detecting a movement In the hostile direction (i.e., from a door or window into the interior of the room), but will be insensitive to movement in the friendly direction (i.e., from the interior of the room towards the window or door). Moreover, each time a movement has been detected, the time interval for disabling the alarm, if not already actuated by a hostile movement, is restarted so that the system will be insensitive to any movements during this time interval, whether in the friendly direction as well as in the hostile direction.

In the described preferred embodiment, the first time interval during which a positive polarity signal and a negative polarity signal must be received before a movement signal is generated, is measured in seconds, e.g., preferably about 4 seconds, which is a reasonable time to assume that both those signals were generated by the same moving object. The second time interval, during which the alarm is disabled after the generation of a movement signal (assuming the alarm has not been actuated by a hostile direction movement) is measured in tens of seconds or minutes, e.g., 40–60 seconds, which is a reasonable time to assume that no intrusion will be attempted through a door/window after a friendly body has been moving in the room. The short time delay imposed on each movement signal for restarting the disabling interval (the second time interval) is a small fraction of a second, e.g., 30 msec., merely to provide enough time for a detected movement in the hostile direction to actuate the alarm before the alarm can be disabled. Once the alarm is actuated, it continues to operate according to the alarm circuit, e.g., intermittently or for a predetermined time interval.

As briefly described above the invention is also applicable in other applications wherein it is necessary or desirable to detect not only the movement of an object within a monitored space, but also the direction of movement of the object. Such applications could include the controlling of automatic doors so as to automatically open the door when a person approaches the door, to automatically close the door when the person is moving away from the door, and to make the door control insensitive to movements parallel to the door. Another possible application of the invention would be to count traffic moving in each direction.

According to another aspect of the present invention, therefore, there is provided a method of detecting movement of an infrared-radiating object in a predetermined direction within a monitored space, comprising: exposing the monitored space to a passive infrared sensor having a first sensor element generating a positive polarity signal when its field of view senses an infrared-radiating moving object, and a second sensor element generating a negative polarity signal when its field of view senses an infrared-radiating moving object; generating a movement signal constituted of a positive polarity signal and a negative polarity signal when both have been generated within a first time interval such as to indicate the movement of an object within the monitored space; and determining from the relative sequential order of the positive polarity signal and negative polarity signal in the movement signal the direction of movement of the detected object.

According to a still further aspect of the present invention, there is provided apparatus for detecting moving infrared-radiating objects in a monitored space, comprising: a passive infrared sensor to be mounted to view the monitored space, the passive infrared sensor having a first sensor element generating a positive polarity signal when its field of view senses an infrared-radiating moving object, and a second sensor element generating a negative polarity signal when its field of view senses an infrared-radiating moving object; a time window circuit for receiving the generated positive polarity signals and negative polarity signals and for generating a movement signal when a positive polarity signal and negative polarity signal have been generated within a first time interval, such as to indicate the movement of an object within the monitored space; and a direction-determining circuit for determining, from the relative sequential order of the positive and negative polarity signals in the movement signal, the direction of movement of the detected object.

According to further features in the preferred embodiment of the invention described below, the apparatus is particularly useful for detecting intrusions and further comprises an alarm; and an alarm actuating circuit which actuates the alarm when the direction of movement of the movement signal is determined to be in a hostile direction, but not when it is determined to be in a friendly direction.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
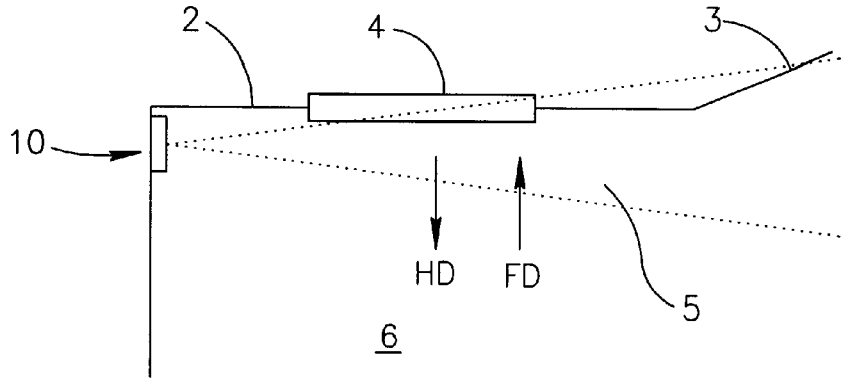
FIG.1 PRIOR ART
FIG. 1 diagrammatically illustrates one application of the invention for providing protection against intrusion through a window or door of a room, without interfering with other movements within the room.

With reference first to FIG. 1, there is illustrated a room 2 or other enclosures having a door 3 and a window 4 to be protected against intrusion. For this purpose, a PIR detector, generally designated 10, is mounted on a wall, or other suitable location, to view the space 5 immediately adjacent the door 3 and window 4 so as to detect objects moving within this space, but to be insensitive to objects moving within the remaining interior region 6 of the room 2.

It is particularly desirable to make the system illustrated in FIG. 1 sensitive only to movements in the direction from the window or door towards the center region 6 of the room (herein called the "hostile" direction) and to make the system insensitive to movements in the direction from the interior region of the room towards the door or window (herein called the "friendly" direction). For this reason, the system, as will be described more particularly below, not only detects movement within the protected space 5, but also determines the direction of such movement so as to enable it to respond only to movements in the hostile direction, but to be insensitive to movements in the friendly direction.

Figure 2:
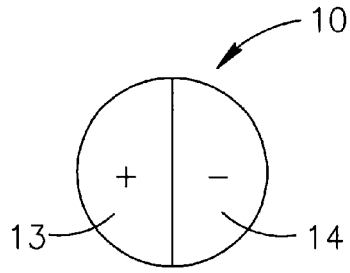
FIG.2 PRIOR ART
FIG. 2 schematically illustrates one form of passive infrared (PIR) detector used in the apparatus of FIG. 1.
Figure 4A:
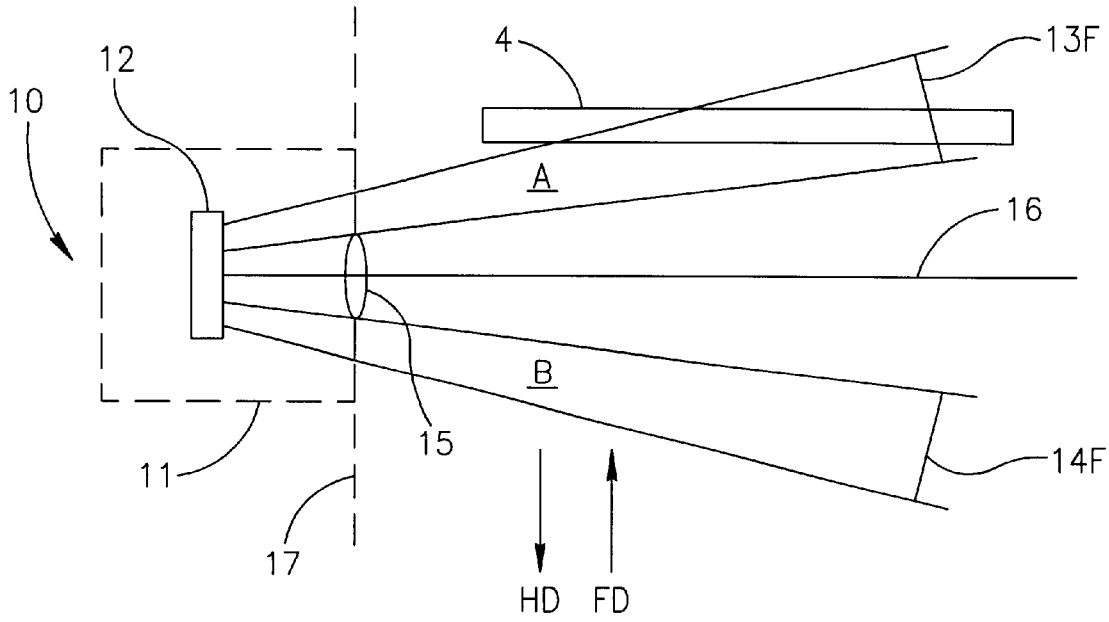
FIG. 4*a* schematically illustrates the main components of a typical PIR detector as commonly supplied for intrusion detection applications.

FIG. 4*a* illustrates the construction of a typical PIR detector as commercially available for intrusion detection purposes. Such a detector 10 includes a housing 11 carrying a printed circuit board (PCB) 12 on which two (or four in a quad-type) IR sensor elements, shown as 13 and 14 in FIG. 2, are mounted for detecting IR-radiating moving objects. Housing 11 includes a window closed by a lens 15 which defines a field of view (FOV) for each of the sensor elements 13, 14. Sensor element 13 generates a positive polarity signal when its field of view senses an IR-radiating moving object; and sensor element 14 generates a negative polarity signal when its field of view senses an IR-radiating moving object.

In the typical PIR detector used for intrusion monitoring, the outputs of the two sensor elements 13, 14 are connected together so that if the object is not-moving they cancel, thereby producing a zero output from the IR detector. Accordingly, the detector ignores non-moving IR-radiating objects, such as heat radiators within the detected space, sunlight entering the protected space, etc., and detects only moving IR-radiating objects, such as persons, by outputting a signal corresponding to the velocity of movement of the objects.

The embodiments of the present invention described below utilize such PIR detectors but include them in a system which not only detects moving objects, but also detects the direction of movement of such objects.

Also, in a typical PIR detector as presently available, the two sensor elements 13, 14, are generally mounted symmetrically with respect to the lens 15; that is, as shown in FIG. 4*a*, the mid-line 16 between the two sensor elements passes through the optical center of the lens 15 and is perpendicular to the transverse axis 17 of the lens.

Figure 4B:
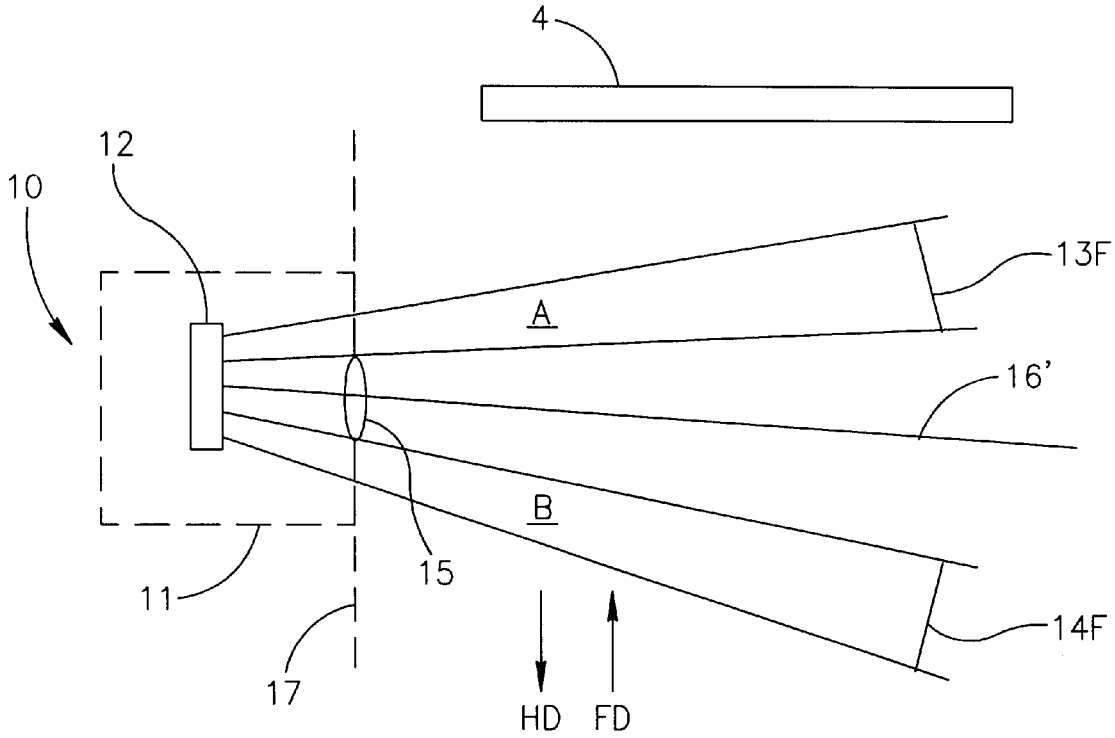
FIG. 4*b* illustrates the PIR detector of FIG. 3 but modified, by shifting its IR sensor elements laterally with respect to its lens, to better adapt it for use in the application of FIG. 1 in accordance with another feature of the invention.

In accordance with another feature of the present invention, the PIR detector 10 illustrated in FIG. 1 is preferably slightly modified as shown in FIG. 4*b*, by shifting the printed circuit board 12, laterally with respect to the fixed lens 15 so that the mid-line 16' between the two sensor elements 13, 14 passing through the center of the lens 15, is no longer perpendicular to the transverse axis 17 of the lens, but rather is slightly oblique with respect to that axis. As will be described more particularly below, such a modification enables a single detector 10 to be located within the room 6 and to efficiently monitor an attempted intrusion through the window or door, and eliminates the need for providing a separate detector externally of the room for this purpose. In a typical example, the distance between the two sensor elements 13, 14, and the lens may be 10–30 mm, in which case the lateral shift would preferably be about 0.5–3 mm. In the example described below, this distance is 25 mm, and the lateral shift is 1–1.5 mm.

Figure 3:
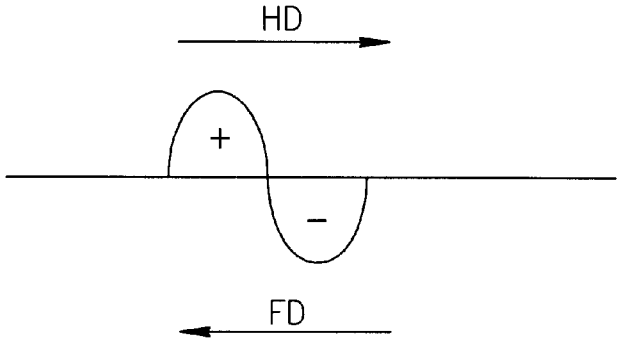
FIG. 3 illustrates the positive and negative polarity signals generated by the PIR detector of FIG. 1 when detecting the movement of an IR-radiating body in one direction.

In FIG. 4, the area 13F indicates the field of view of sensor element 13 of the PIR detector 10, and the area 14F indicates the field of view of the sensor element 14. Sensor element 13 is connected to produce a positive polarity signal when detecting an IR-radiating moving body, and sensor element 14 is connected to produce a negative polarity signal when detecting an IR-radiating moving body. Accordingly, when a body moves In the hostile direction (indicated by arrow HD in FIGS. 1 and 4*b*) i.e., from the window 4 towards the center of the room, a positive polarity signal (A+) will first be generated in the field of view 13F, and then a negative polarity signal (B−) will be generated in the field of view 14F, as shown in FIG. 3. On the other hand, if the body is moving in the friendly direction (indicated by arrow FD in FIGS. 1 and 4*b*) i.e., from the center of the room towards the window, such body will first generate a negative polarity signal (B−) in field of view 14F, and then a positive polarity signal (A+) in field of view 13F.

Thus, when both a positive polarity signal and a negative polarity signal are detected within a predetermined time interval indicating that both signals are generated by the same body, this determines that a body is moving within the field of view of the detector; and by examining the sequence of the two signals, this enables a determination to be made of the direction of movement of that body.

Figure 5:
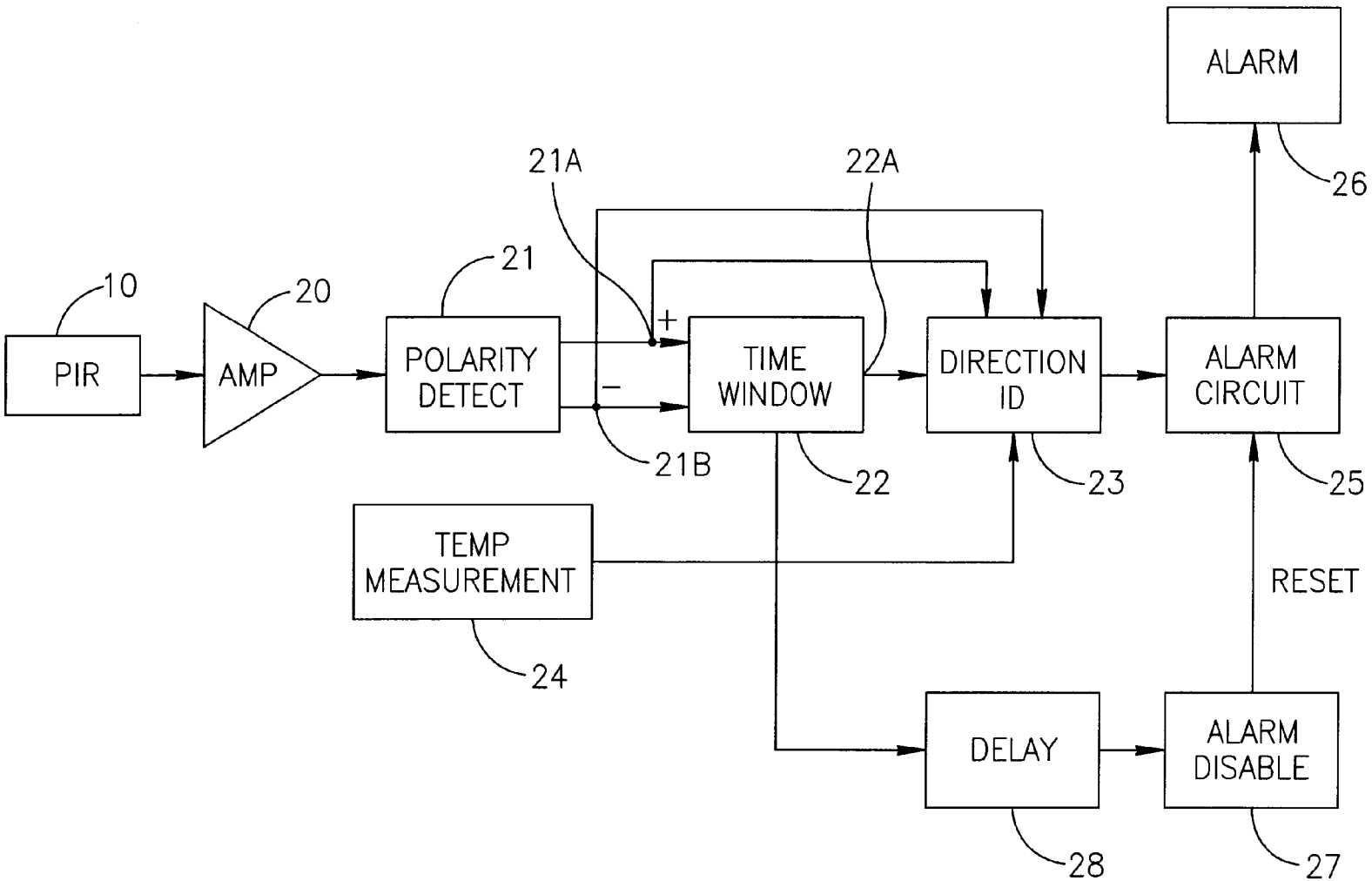
FIG. 5 is a block diagram illustrating the functional blocks in one form of apparatus constructed in accordance with the present invention.

FIG. 5 is a block diagram illustrating apparatus for using the foregoing mechanisms for detecting the presence of an object moving within the monitored space defined by the fields of view of detector 10 in the hostile direction HD (from the window towards the interior of the room) and to ignore movements of objects in the friendly direction FD (from the interior of the room towards the window or door) so as not to interfere with normal activities within the room.

Thus, as shown in FIG. 5, detector 10 feeds its output signals to an amplifier 20, and then to a polarity detector 21 which determines the polarity of each received signal passing a predetermined threshold. Each positive pulse signal is outputted via port 21*a* to a time window circuit 22, and each negative polarity signal is outputted via port 21*b* to time window circuit 22.

Time window circuit 22 is open for a predetermined time interval, e.g., 4 seconds. If a positive polarity signal and a negative polarity signal have both been received within this time interval, the time window circuit generates a movement signal at its output port 22*a,* constituted of a positive polarity signal and a negative polarity signal as illustrated in FIG. 3. The 4 second time interval during which this window is open shows that both pulses received are from the same moving body.

The sequential order of the positive and negative portions of the movement signal indicates the direction in which the body was moving. Thus, as described above, if a detected body was moving in the hostile direction HD (FIG. 4), the movement signal will be A+, B−; and if in the friendly direction FD, the movement signal will be of the opposite sequence, B−,A+.

The movement signal is outputted from time window circuit 22 into a direction identffication circuit 23, which determines the direction of movement of the detected object, as described above. However, the above description for determining direction assured that the ambient temperature was below body temperature. Thus, when the ambient temperature is below body temperature (36° C.), the signal sequence is as described above, i.e., A+, B− for movement in the hostile direction HD, and B−,A+ for movement in the friendly direction FD. However, if the ambient temperature is above the body temperature (36° C.), the output of the sensor elements will be of the opposite polarity, so that the above sequence will be reversed for the two directions.

Accordingly, FIG. 5 illustrates a temperature measuring circuit 24 which measures the ambient temperature and controls the direction identification circuit 23 in accordance with the measured temperature. The absolute temperate need not be measured, as it is only necessary to determine whether the ambient temperature is above or below the body temperature (36° C.), and to control the direction identification circuit 23 accordingly.

The direction identification circuit 23, therefore, receives an input from the time window circuit 22. However, it also, as inputs, the positive polarity signal 21*a* and the negative polarity signal 21*b* from the polarity detector circuit 21, and the temperature measurement signal from the temperature measuring circuit 24. From these inputs, circuit 23 determines the direction of movement of the detected object.

If the direction is in the hostile direction HD as shown in FIGS. 2; and 4*b* (from the window or door towards the interior of the room), circuit 23 outputs an alarm signal to an alarm actuator circuit 25 which immediately actuates the alarm 26. If, however, circuit 23 determines that the detected object was moving in the friendly direction FD (from the room interior towards the window or door), no alarm signal is outputted to the alarm circuit 25, and therefore no alarm is actuated.

The system illustrated in FIG. 5 further includes an alarm disable circuit 27 for disabling the alarm circuit 25 in order to permit normal movements within the room for a predetermined time interval after a generated movement signal has been determined to be in the friendly direction FD. This disabling of the alarm circuit 25 is effected by each movement signal from the time window 22, which is applied, after a short delay by delay circuit 28, to the alarm disable circuit 27. Each time such a movement signal is received from circuit 22 via delay circuit 28, the time interval during which the alarm circuit 25 is disabled is restarted.

As typical examples, delay circuit 28 may impose a delay of about 30 msec in the time each movement signal from the time window 22 is applied to the alarm disable circuit 27, and the disable circuit 27 may disable the alarm circuit 25 for a time interval of about 40–60 seconds.

The system illustrated In FIG. 5 thus operates as follows:

The space adjacent the window and door in FIGS. 1 and 4*b* is continuously monitored by detector 10. Should an object move in the hostile direction HD, namely from the window or door towards the center of the room, a positive polarity signal (A+) will be generated by sensor element 13 in field of view A (FIG. 4*b*), and a negative polarity signal (B−) will then be generated by sensor 14 in field of view B. If the movement is in the friendly direction FD, the negative polarity signal B− will first be generated, and then the positive polarity signal A+.

The signals generated by detector 10 are amplified in amplifier 20, and applied to polarity detector circuit 21. Circuit 21 determines the polarity of each received signal passing a predetermined threshold, and outputs each positive signal via output 21*a,* and each negative signal via output 21*b*. These signals are received by the time window circuit 22, and when both a positive signal and a negative signal have been received within a predetermined time interval (e.g., 4 seconds) circuit 22 determines that a movement has occurred in the detected object and outputs a movement signal to circuit 23. The latter circuit receives, in addition to the movement signal from time window circuit 22, also the positive and negative polarity signals from polarity detector 21, and also the temperature signal from the temperature measuring circuit 24, and from this confirmation determines whether the detected object was moving in the hostile direction HD, or in the friendly direction FD. If it was moving in the hostile direction HD, it immediately actuates the alarm circuit 25, which actuates the alarm 26. If, however, the detected direction of movement was in the friendly direction FD, no alarm signal is outputted to alarm circuit 25, and therefore the alarm is not actuated.

The alarm disable circuit 27 prevents the alarm circuit from being actuated for a predetermined interval, e.g., 40–60 seconds, after a detected object has been found to be moving in the friendly direction. Thus, if an object after having moved in the friendly direction moves in the hostile direction within this time interval, the alarm is disabled from being actuated. For example, a friendly object may move in a friendly direction and thereafter, during this predetermined time interval, may move in many other directions within the monitored space, in which case it is not desired to have the alarm be actuated should the object move in the hostile direction during the time interval.

Thus, each movement signal produced by the time window circuit 22 will, after experiencing a short delay (e.g. 30 msec), be applied to the alarm disable circuit 27 to restart the disable period (40–60 sec). This disable will not be effective to prevent the actuation of the alarm 26 by the alarm circuit 25 when an object is detected outside of the disable period, since the actuation of the alarm is immediate when the movement signal is determined by circuit 23 to be in the hostile direction. However, where the alarm disable circuit 27 is not actuated, each movement signal thereafter from the time window circuit 22 will be subjected to a short delay imposed by the delay circuit 28 before it is applied to the alarm-disable circuit 27.

Thus, once it has been determined that the detected object is moving in the friendly direction, alarm disable circuit 27 is effective to disable the alarm circuit 25 for a predetermined interval (e.g., 40–60 sec), and thereafter to restart that predetermined interval with each subsequent motion signal from circuit 22 so as not to interfere with normal activity during this disable period.

Figure 6A:
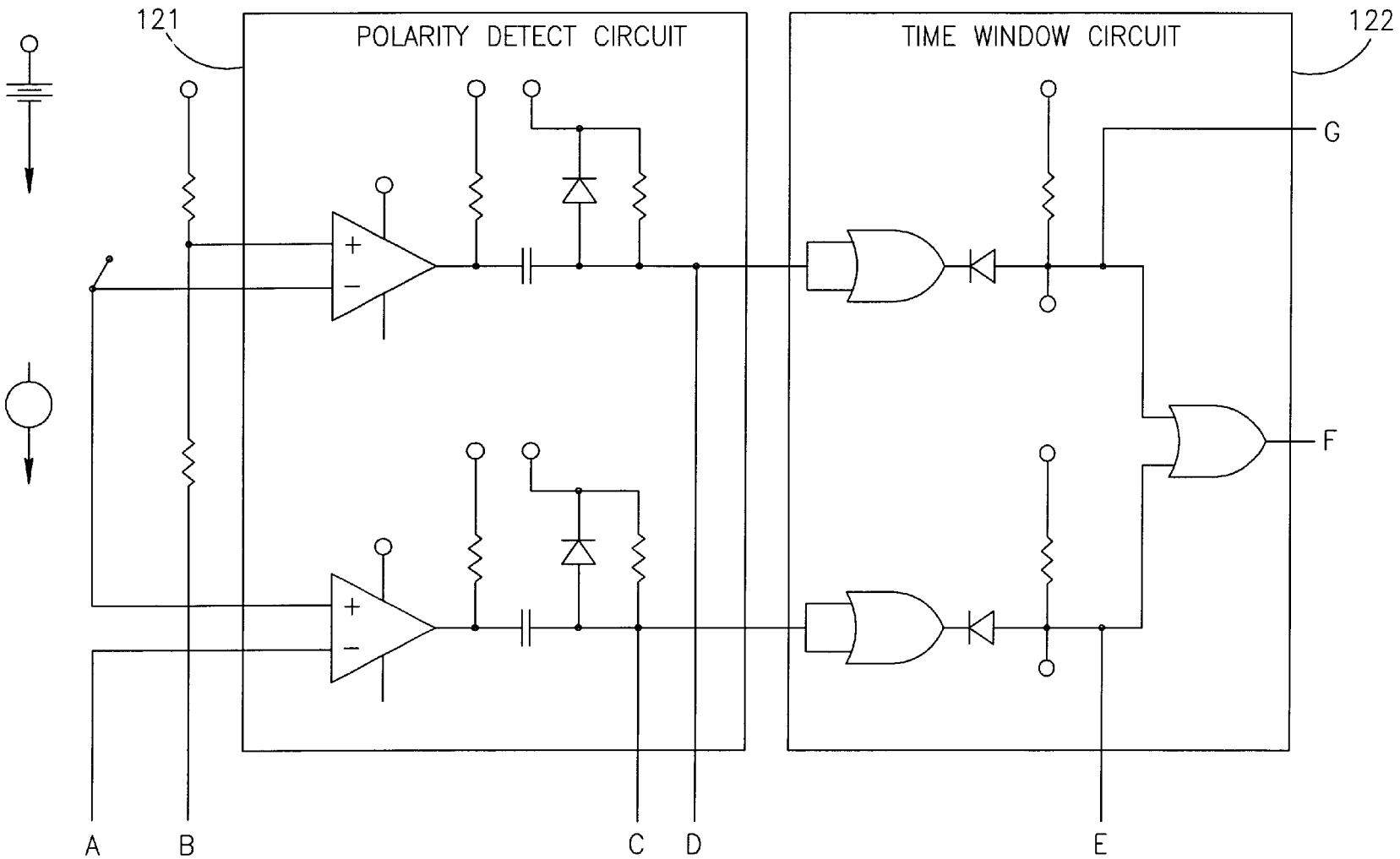
FIG. 6 is a circuit diagram illustrating an analog-circuit implementation of the invention.
Figure 6B:
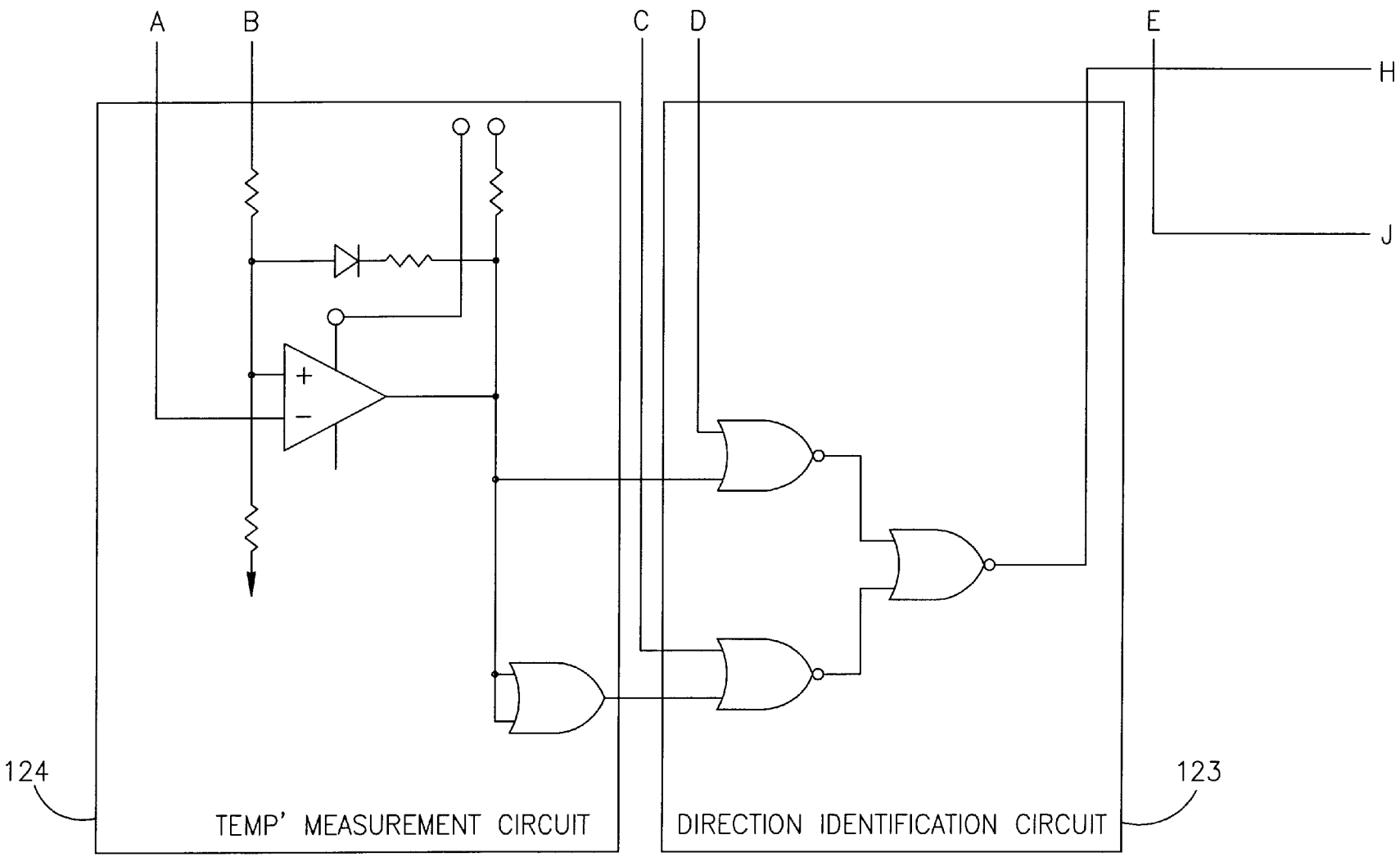
Figure 6C:
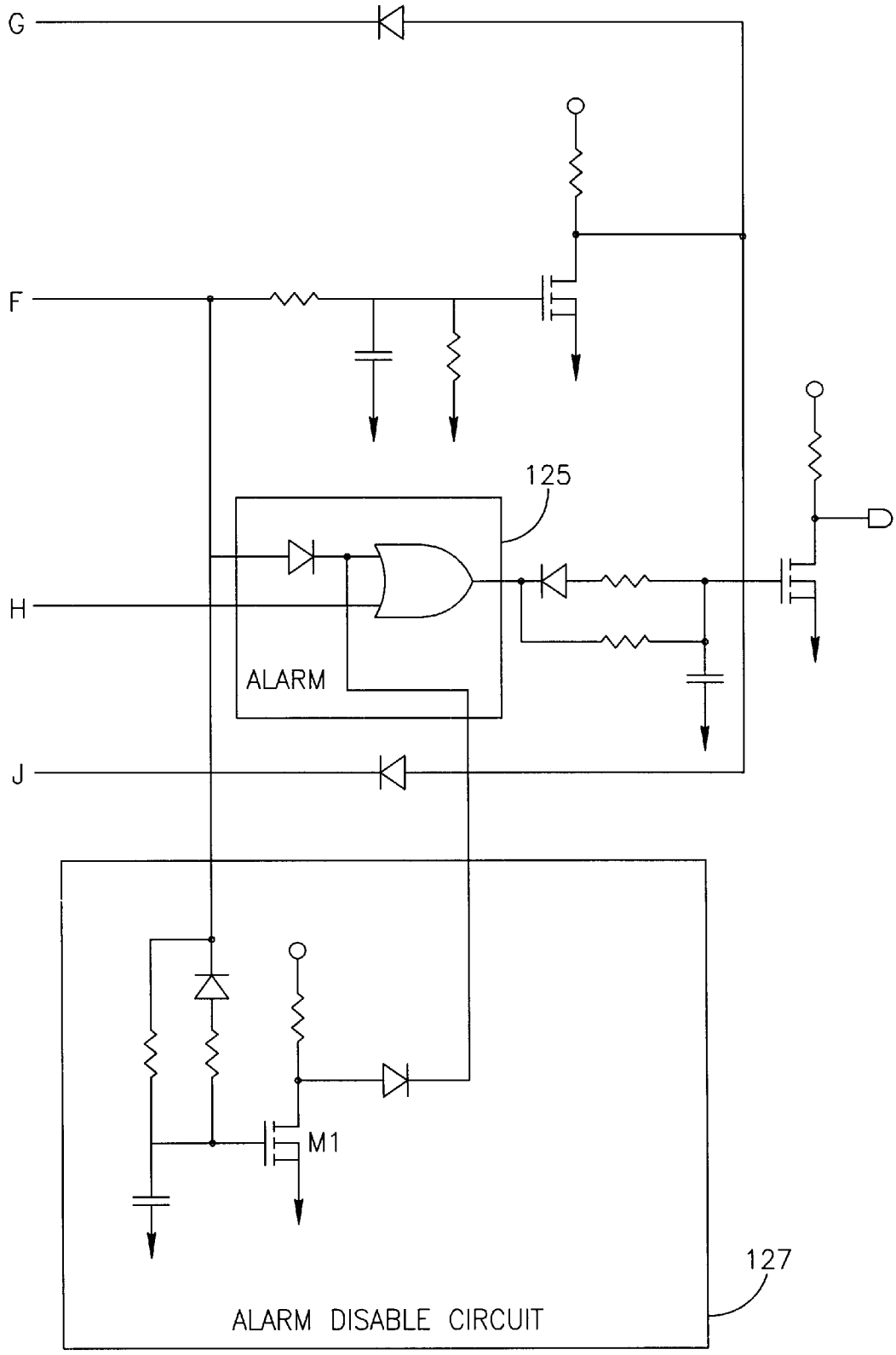

FIG. 6 is a circuit diagram illustrating an analog-circuit implementation of the system of FIG. 5. As shown in FIG. 6, the elements within box 121 generally perform the function of the polarity detect circuit 21 in FIG. 5; the elements within box 122 generally perform the function of the time window circuit 22 in FIG. 5; the elements within box 123 generally perform the function of the direction identification circuit 23; the elements within box 124 generally perform the function of the temperature measuring circuit 24; the elements within box 125 generally perform the function of the alarm circuit 25; and the elements within box 127 generally perform the functions of the alarm disable circuit 27 and the delay circuit 28. Transistor M2 within box 127 functions to disable the actuation of the alarm circuit 25 for 40–60 seconds whenever two pulses of opposite polarity are outputted by the time window circuit 122 within the time interval (4 seconds) of the window. The two pulse of opposite polarity constitute a motion signal which, when occurring, produces a "1" in the inlet to circuit element UTD, which disables the alarm from actuation during the 40–60 second interval.

Figure 7A:
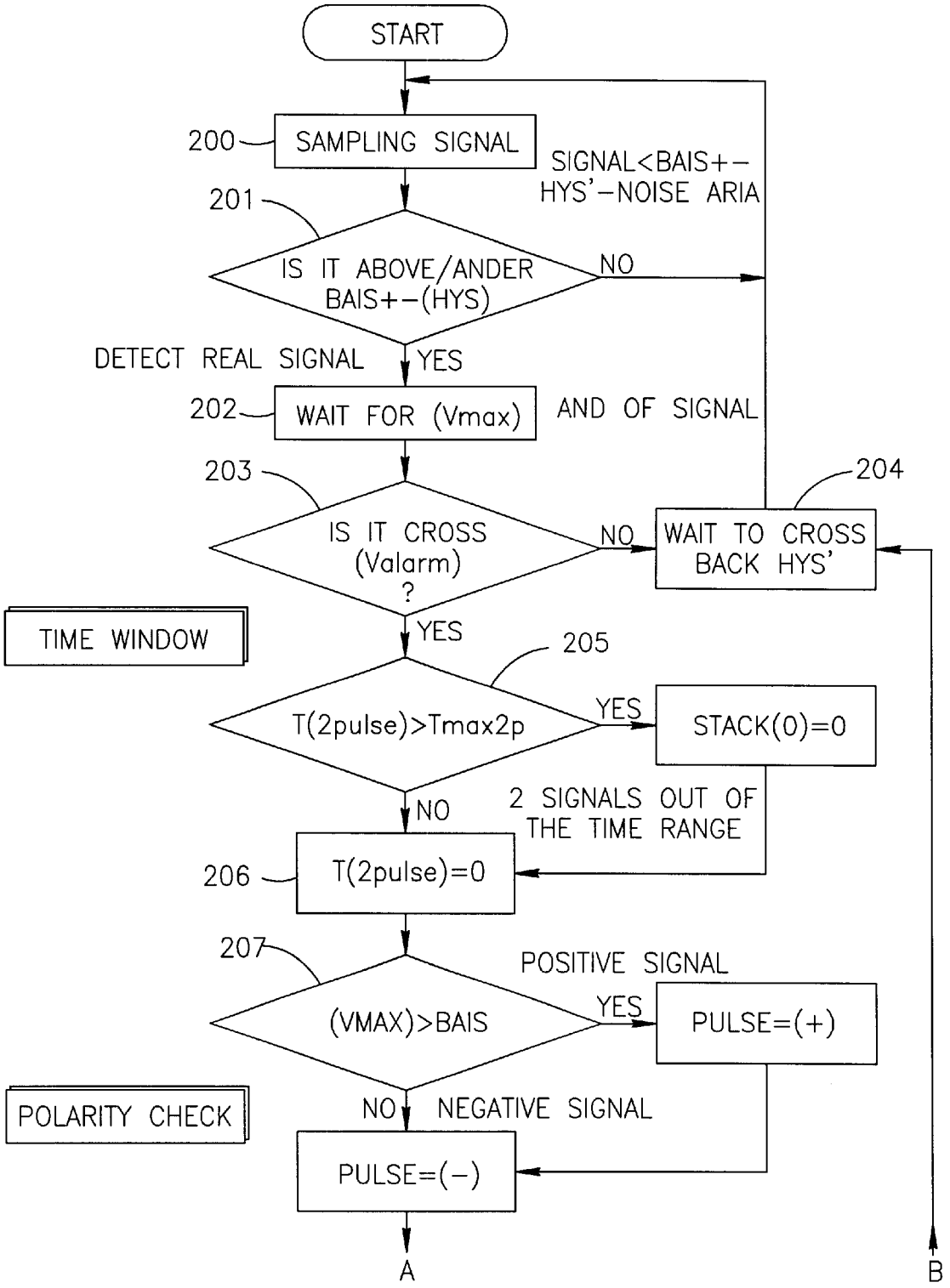
FIG. 7 is a flow chart illustrating a digital-circuit implementation of the invention.
Figure 7B:
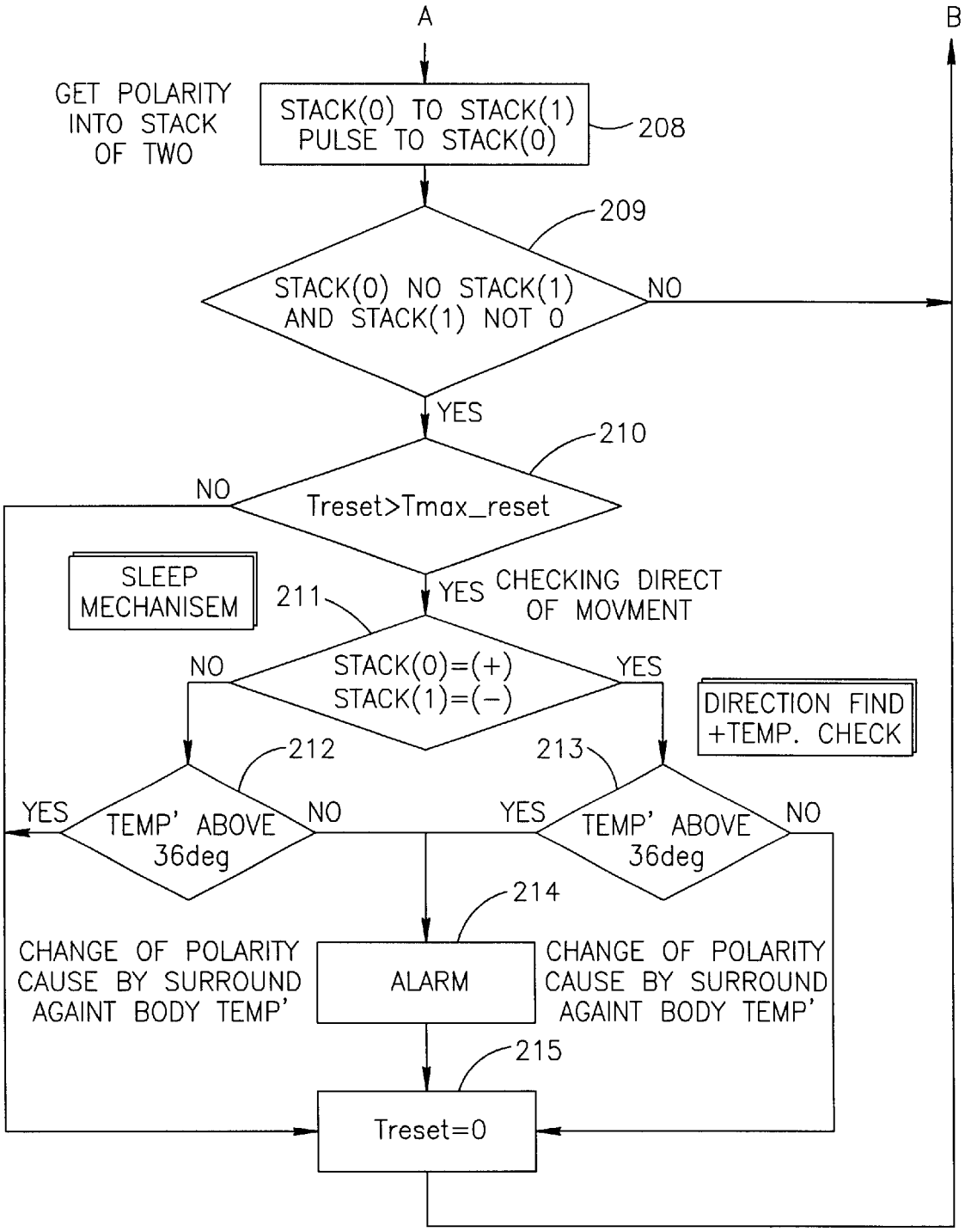

FIG. 7 is a flow chart illustrating a digital-circuit implementation of the system of FIG. 5. Thus blocks 200–204 generally perform the functions of the polarity detector 21 which detects a positive polarity signal and a negative polarity signal passing a predetermined threshold; blocks 205–207 generally perform the function of the time window circuit 22; blocks 208–211 generally perform the function of the direction identification circuit 23; blocks 212 and 213 generally perform the function of the temperature measuring circuit 24; block 214 generally performs the function of the alarm detector 25; and block 215 generally performs the function of the alarm disable circuit 27, While the invention has been described with respect to one preferred embodiment, it will be appreciated that this is set forth merely for purposes of example, and that many other variations, modifications and applications of the invention may be made.

What is claimed is:

1. A method of detecting intrusions with respect to a monitored space, comprising exposing said monitored space to a passive infrared sensor having a first sensor element generating a positive polarity signal when its field of view senses an infrared-radiating moving object, and a second sensor element generating a negative polarity signal when its field of view senses an infrared-radiating moving object;

generating a movement signal constituted of a positive polarity signal and a negative polarity signal when both have been generated within a first time interval such as to indicate the movement of an object within the monitored space;

determining from the relative sequential order of the positive polarity signal and negative polarity signal in said movement signal the direction of movement of the detected object, and particularly whether the movement direction is a hostile direction or a friendly direction; and actuating an alarm when the direction of movement of the movement signal is determined to be in the hostile direction, but not when it is determined to be in the friendly direction.

2. The method according to claim 1, wherein said method further comprises disabling the actuation of said alarm during a second time interval after a generated movement signal has been determined to be in the friendly direction.

3. The method according to claim 2, wherein said disabling of the actuation of the alarm is effected by applying each movement signal, after a short time delay, to restart said second time interval during which the actuation of the alarm is disabled.

4. The method according to claim 3, wherein said first time interval is measured in seconds, said second time interval is measured in tens of seconds or minutes, and said short time delay is measured in a small fraction of a second.

5. The method according to claim 1, wherein said method further comprises determining whether the temperature of the monitored space is above or below body temperature (approximately 36° C.), and utilizing said latter determination to determine from said sequential order of positive and negative polarity signals, the direction of movement of the body generating said movement signal.

6. The method according to claim 1, wherein the monitored space is a door or window of an enclosure and said hostile direction is from the door or window into the interior of the enclosure.

7. The method according to claim 6, wherein only the space within, and at one side of, the enclosure in the region of the door or window, is exposed to the passive infrared sensor.

8. A method of detecting movement of an infrared-radiating object in a predetermined direction Within a monitored space, comprising:

exposing said monitored space to a passive infrared sensor having a first sensor element generating a positive polarity signal when its field of view senses an infrared-radiating moving object, and a second sensor element generating a negative polarity signal when its field of view senses an infrared-radiating moving object;

generating a movement signal comprising a positive polarity signal and a negative polarity signal when both have been generated within a first time interval such as to indicate the movement of an object within the monitored space; and determining from the relative sequential order of the positive polarity signal and negative polarity signal in said movement signal the direction of movement of the detected object.

9. The method according to claim 8, wherein said method further comprises determining whether the temperature of the monitored space is above or below body temperature (approximately 36° C.), and utilizing said latter determination to determine the direction of movement of the body generating said movement signal.

10. The method according to claim 8, wherein the monitored space is a door or window of an enclosure, and the passive infrared sensor is mounted to monitor only the space within, and at one side of, the enclosure in the region of the door or window.

11. Apparatus for detecting moving infrared-radiating objects in a monitored space, comprising:

a passive infrared sensor to be mounted to view said monitored space, said passive infrared sensor having a first sensor element generating a positive polarity signal when its field of view senses an infrared-radiating moving object, and a second sensor element generating a negative polarity signal when its field of view senses an infrared-radiating moving object;

a time window circuit for receiving the generated positive polarity signals and negative polarity signals and for generating a movement signal when a positive polarity signal and negative polarity signal have both been generated within a first time interval such as to indicate the movement of an object within the monitored space; and a direction-determining circuit for determining, from the relative sequential order of the positive and negative polarity signals in said movement signal, the direction of movement of the detected object.

12. The apparatus according to claim 11, particularly useful for detecting intrusions in said monitored space, wherein said apparatus further comprises:

an alarm; and an alarm actuating circuit which actuates the alarm when the direction of movement of the movement signal is determined to be in a hostile direction, but not when it is determined to be in a friendly direction.

13. The apparatus according to claim 12, wherein said apparatus further comprises:

a disabling circuit for disabling the actuation of said alarm during a second time interval after a generated movement signal has been determined to be in the friendly direction.

14. The apparatus according to claim 13, wherein said apparatus further comprises:

a delay circuit for receiving each movement signal and, after a short time delay, for applying said movement signal to said disabling circuit to restart said second time interval.

15. The apparatus according to claim 14, wherein said first time interval is measured in seconds, said second time interval is measured in tens of seconds or minutes, and said short time delay is measured in a small fraction of a second.

16. The apparatus according to claim 11, wherein said apparatus further comprises a temperature sensor for sensing the temperature of the monitored space, and for utilizing said sensed temperature to determine from said sequential order of positive and negative polarity signals, the direction of movement of the body generating said movement signal.

17. The apparatus according to claim 11, wherein said first and second sensor elements are mounted on a base enclosed within a housing having a lens defining said fields of view; said base being shifted laterally with respect to said lens such that the mid-line between said first and second sensor elements passes obliquely through the transverse optical axis of the lens, to thereby produce fields of view of the sensor elements which are non-symmetrical with respect to the lens.

18. The apparatus according to claim 17, wherein the distance between said first and second sensor elements and said lens is 10–30 mm, and said lateral shift is 0.5–3 mm.

19. The apparatus according to claim 17, wherein said passive infrared sensor is mounted on one side of a door or window of an enclosure so as to monitor only the space within, and at one side of, the enclosure in the region of the door or window.

20. The apparatus according to claim 18, wherein said passive infrared sensor is mounted on one side of a door or window of an enclosure so as to monitor only the space within, and at one side of, the enclosure in the region of the door or window.

* * * * *